US005401622A

United States Patent [19]

Yamada

[11] Patent Number: 5,401,622

[45] Date of Patent: Mar. 28, 1995

[54] THERMALLY DEVELOPABLE COLOR PHOTOSENSITIVE MATERIALS WITH U.V. ABSORBERS

[75] Inventor: Makoto Yamada, Kanagawa, Japan

[73] Assignee: Fuji Photo Film Co., Ltd., Kanagawa, Japan

[21] Appl. No.: 141,009

[22] Filed: Oct. 26, 1993

[30] Foreign Application Priority Data

Oct. 26, 1992 [JP] Japan ..... 4-287820

[51] Int. Cl.[6] ..... G03C 5/54; G03C 7/26

[52] U.S. Cl. ..... 430/512; 430/203; 430/216; 430/220; 430/222; 430/546; 430/931

[58] Field of Search ..... 430/203, 216, 220, 222, 430/223, 546, 512, 931

[56] References Cited

U.S. PATENT DOCUMENTS

| | | | |
|---|---|---|---|
| 4,559,290 | 12/1985 | Sawada et al. | 430/223 |
| 4,783,396 | 11/1988 | Nakamura et al. | 430/353 |
| 5,026,634 | 6/1991 | Ono et al. | 430/216 |
| 5,047,314 | 9/1991 | Sakai et al. | 430/546 |
| 5,139,919 | 8/1992 | Taguchi et al. | 430/223 |

*Primary Examiner*—Richard L. Schilling

*Attorney, Agent, or Firm*—Sughrue, Mion, Zinn, Macpeak & Seas

[57] ABSTRACT

A thermally developable color photosensitive material comprises a support, having thereon a photosensitive silver halide, a binder, an electron transfer agent, an electron donor, and a reducible dye donating compound which is capable of being reduced and releasing a diffusible dye, wherein the reducible dye donating compound and a compound represented by the following formula (1) are present together in the form of an emulsified dispersion in the binder.

7 Claims, No Drawings

THERMALLY DEVELOPABLE COLOR PHOTOSENSITIVE MATERIALS WITH U.V. ABSORBERS

FIELD OF THE INVENTION

The present invention concerns thermally developable color photosensitive materials, particularly thermally developable color photosensitive materials with which image discrimination is excellent and which are suitable for mass production.

BACKGROUND OF THE INVENTION

Thermally developable photosensitive materials are known, and thermally developable photosensitive materials and the processes involved have been described, for example, on pages 242–255 of *Fundamentals of Photographic Engineering, Non-silver Salt Photography Section* (published by Corona, 1982) and in U.S. Pat. No. 4,500,626.

In addition, methods for the formation of dye images by means of a coupling reaction between the oxidized form of a developing agent and couplers have been described, for example, in U.S. Pat. Nos. 3,761,270 and 4,021,240. Furthermore, methods for the formation of positive color images using a photosensitive silver dye-bleach system have been described, for example, in U.S. Pat. No. 4,235,957.

Methods in which diffusible dyes are released or formed in the form of an image by thermal development and in which the diffusible dyes are transferred to a dye fixing element have been proposed more recently. With these methods, it is possible to obtain both negative dye images and positive dye images by changing the type of dye donating compounds which are used or by changing the type of silver halide which is used. More details have been disclosed, for example, in U.S. Pat. Nos. 4,500,626, 4,483,914, 4,503,137 and 4,559,290, JP-A-58-149046, JP-A-60-133449, JP-A-59-218443, JP-A-61-238056, European Patent laid open 220746A2, Kokai Giho 87-6199 and European Patent laid open 210660A2. (The term "JP-A" as used herein signifies an "unexamined published Japanese patent application".)

Many methods have also been suggested for obtaining positive color images by thermal development. For example, a method has been proposed in U.S. Pat. No. 4,559,290, in which compounds for which so-called DDR compounds have been formed into a oxide form which has no dye releasing capacity and a reducing agent or precursor thereof are included, the reducing agent is oxidized in accordance with the exposure of the silver halide by thermal development, reduction is achieved with the remaining un-oxidized reducing agent and a diffusible dye is released. Furthermore, thermally developable photosensitive materials in which compounds which release diffusible dyes by a reductive cleavage of an N—X bond (where X represents an oxygen atom, a nitrogen atom or a sulfur atom) are used as compounds which release a diffusible dye via the same mechanism, have been disclosed in European Patent laid open 220746A and in Kokai Giho 87-6199 (Vol. 12 No. 22)

When photographically useful additives, such as dye donating compounds, which are insoluble in water are added to a photosensitive material such as those mentioned above, the addition is generally made by the method of emulsification and dispersion which is well known to those in this field. In the emulsification and dispersion method, the photographically useful additive is dissolved together with a high boiling point organic solvent in a low boiling point organic solvent, and the solution is added to an aqueous gelatin solution in the presence of an appropriate surfactant and emulsified and dispersed as an O/W type emulsion using an emulsifying machine such as a homogenizer for example, and such methods have been disclosed, for example, on pages 213–255 of *Fundamentals of Photographic Engineering, Silver Salt Photography Section* (published by Corona, 1978) and U.S. Pat. No. 2,322,027. Coating liquids which contain emulsions which have been prepared using the abovementioned method of emulsification and dispersion are not used immediately after preparation. Rather they are used after being kept warm and ageing after preparation. But when a coating liquid which has been kept warm and aged in this way is used, there are cases where large lumpy particles are formed by cohesion of the emulsion particles and by precipitation of the photographically useful additives which are insoluble in water such as the dye donating compounds for example, and spot-like defects are produced in the image and discrimination becomes poor.

SUMMARY OF THE INVENTION

Hence, one object of the present invention is to provide thermally developable color photosensitive materials with which images which have good discrimination can be obtained even in cases where they are manufactured using coating liquids which have been kept warm and aged.

Another object of the present invention is to provide thermally developable color photosensitive materials with which there is less deterioration of the image which is obtained after the sensitive material has been left to stand for a long period of time or under more rigorous conditions.

These and other objects of the present invention have been realized by means of the invention described below.

A thermally developable color photosensitive material comprises a support, having thereon, a photosensitive silver halide, a binder, an electron transfer agent, an electron donor and a reducible dye donating compound which is capable of being reduced and releasing a diffusible dye, wherein the reducible dye donating compound and a compound represented by the following formula (1) are present together in the form of an emulsified dispersion in the binder.

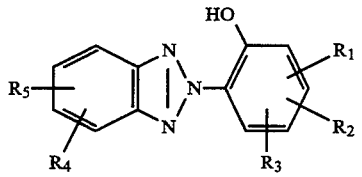

(1)

In formula (1), $R_1$–$R_5$, which may be the same or different, each represents a hydrogen atom, a halogen atom, or a substituted or unsubstituted aliphatic group, aromatic group, alkoxy group, aryloxy group, alkylthio group, arylthio group, alkylamino group, nitro group, carboxylic acid amido group, sulfonamido group, carbamoyl group, sulfamoyl group, sulfonic acid group or ester or salt thereof, carboxylic acid group or ester or salt thereof, or heterocyclic group, $R_3$–$R_5$ may undergo ring closure with adjoining groups to form five- or six-membered rings, dimers or larger oligomers may be formed by bonding between any of the substituent groups $R_1$–$R_5$, and polymeric compounds may be formed by bonding into a .polymer chain with any $R_1$–$R_5$.

DETAILED DESCRIPTION OF THE INVENTION

The term "emulsified dispersion" as used herein means that components are contained together in each of the oil droplets in an emulsified dispersion.

The compounds represented by the aforementioned formula (1) for use in the present invention are described in detail below. $R_1$–$R_5$, when representing the groups other than a hydrogen atom and a halogen atom, each preferably contains 1–20 carbon atoms.

Preferred examples of $R_1$–$R_5$ in formula (1) include: halogen atoms (fluorine, chlorine, bromine), aliphatic groups (for example methyl, ethyl, n-propyl, i-propyl, sec-butyl, t-butyl, t-amyl, t-hexyl, n-octyl, 2-ethylhexyl, t-octyl, dodecyl, hexadecyl, trifluoroacetyl, benzyl), aromatic groups (for example, phenyl, tolyl, 4-methoxyphenyl, naphthyl), alkoxy groups (for example, methoxy, ethoxy), aryloxy groups (for example, phenoxy), alkylthio groups (for example, n-butylthio, n-octylthio, dodecylthio), arylthio groups (for example, phenylthio), alkylamino groups (for example, diethylamino, dibutylamino, benzylamino, di-2-ethylhexylamino), carboxylix acid amido groups (for example, acetamido, benzamido, trifluoroacetamido), sulfonamido groups (for example, methanesulfonamido, benzenesulfonamido, toluenesulfonamido), carbamoyl groups (for example, carbamoyl, dimethylcarbamoyl, dodecylcarbamoyl), sulfamoyl groups (for example, sulfamoyl, dimethylsulfamoyl, phenylsulfamoyl), and heterocyclic groups (for example, pyridyl, quinolyl, thienyl, furyl, benzothiazolyl).

The compounds represented by formula (1) may be formed into dimers or larger oligomers by being bonded together via any of the substituent groups $R_1$–$R_5$, or they may be formed into polymeric compounds by bonding via any of the substituent groups $R_1$–$R_5$ into a polymer chain.

Examples of compounds represented by formula (1) are shown below, but the compounds are not limited to these examples.

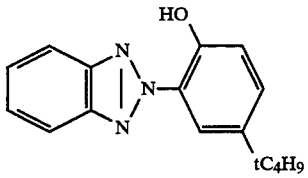

(1)

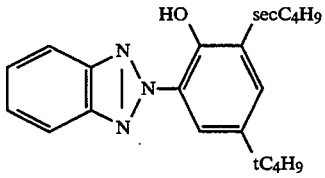

(2)

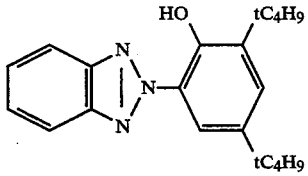

(3)

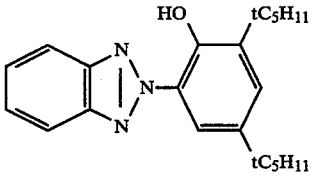

(4)

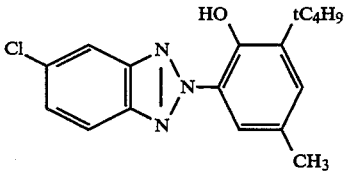

(5)

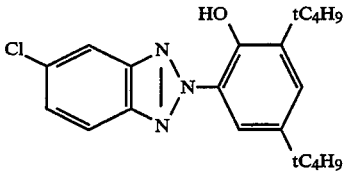

(6)

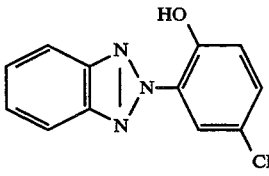

(7)

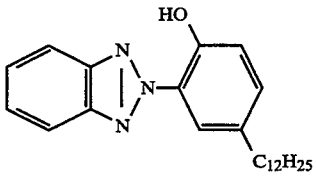

(8)

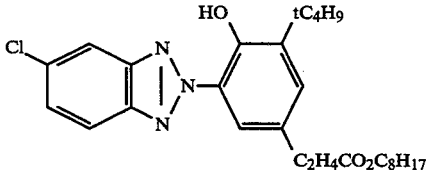

(9)

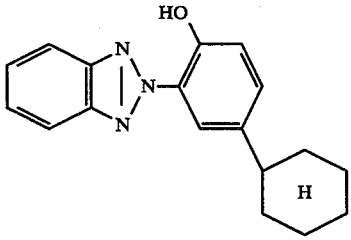

(10)

-continued
(11)
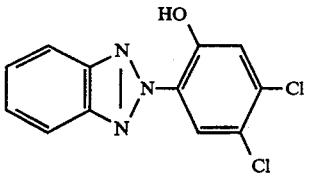
(12)
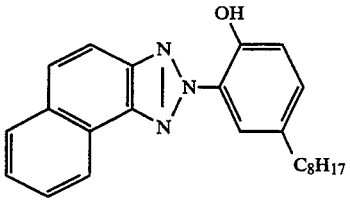
(13)
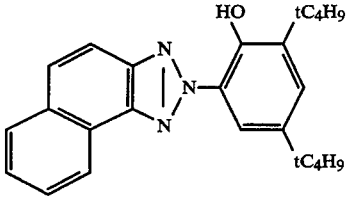
(14)
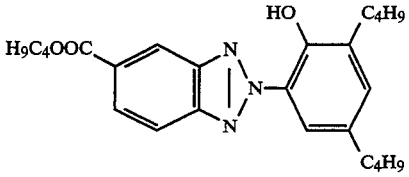
(15)
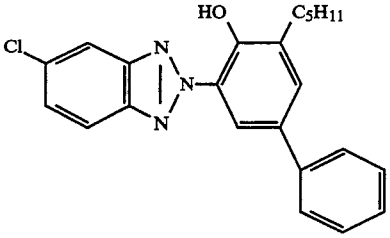
(16)
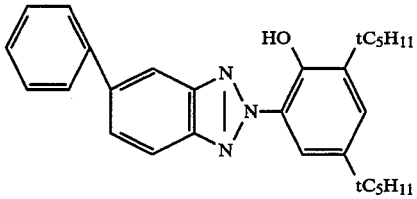
(17)
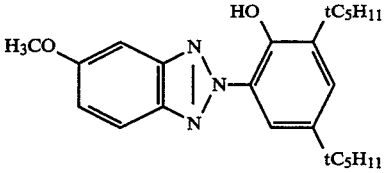
(18)
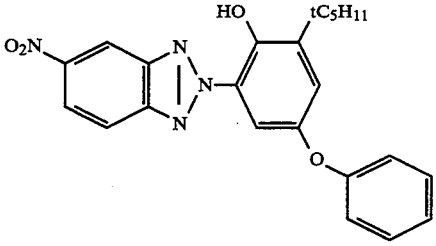
(19)
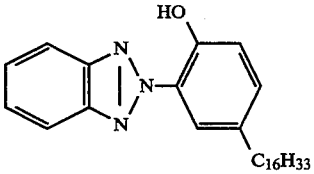
(20)
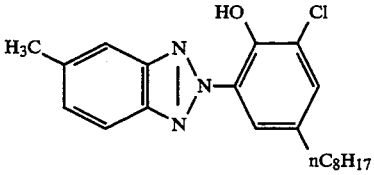
(21)
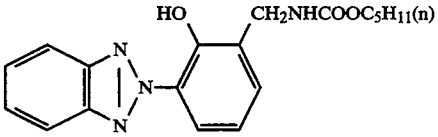
(22)
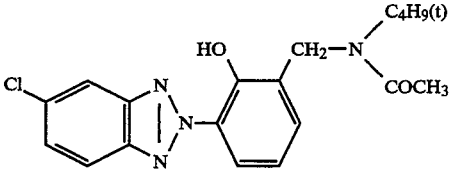
(23)
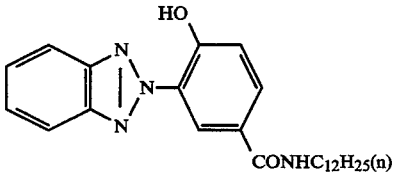
(24)
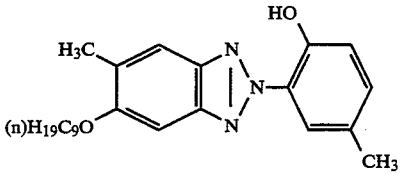
(25)
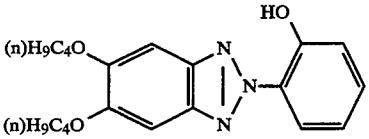
(26)
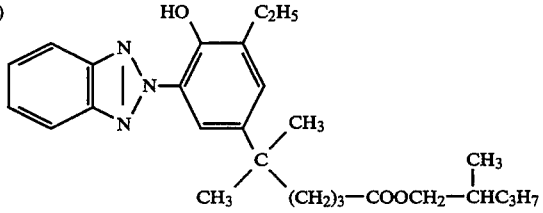

-continued (27)

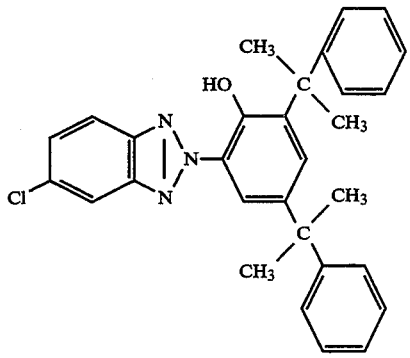

(28)

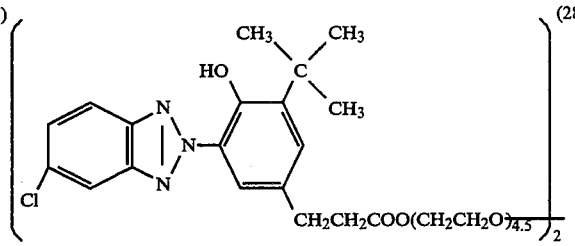

(29)

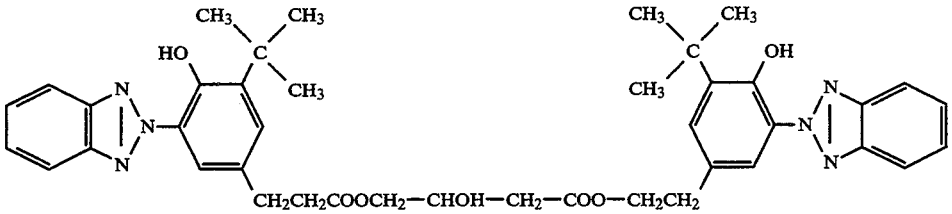

(30)

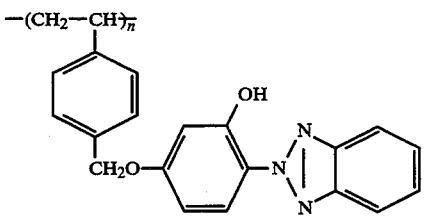

(31)

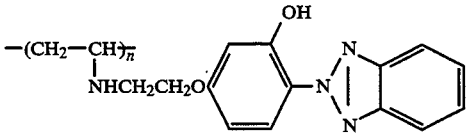

These compounds are known as ultraviolet absorbers. But when they are used together with a reducible dye donating compound in the form of an emulsified dispersion they improve the stability of the emulsion without loss of photographic performance and this effect was completely unexpected.

The reducible dye donating compound, the compound of formula (1), the electron transfer agent and the electron donor may be contained together in the form of an emulsified dispersion.

Any proportion of the compound represented by formula (1) may be used, but it is preferably used in an amount of 0.1–100 percent by weight, and most desirably in an amount of 1–50 percent by weight, with respect to the dye donating compound which is described hereinafter. In the present invention, the compounds represented by formula (1) can be used individually, or two or more of these compounds may be used conjointly.

In the present invention, the method disclosed in U.S. Pat. No. 2,322,027, using high boiling point organic solvents such as, for example, alkyl esters of phthalic acid (for example, dibutyl phthalate, dioctyl phthalate), phosphate esters (for example, diphenyl phosphate, triphenyl phosphate, tricyclohexyl phosphate, tricresyl phosphate, dioctyl butyl phosphate), citric acid esters (for example, tributylacetyl citrate), benzoic acid esters (for example, octyl benzoate), alkyl amides (for example, diethyl laurylamide), fatty acid esters (for example, dibutoxyethyl succinate, dioctyl azelate), trimesic acid esters (for example, tributyl trimesitate), the carboxylic acids disclosed in JP-A-63-85633 and compounds such as those disclosed in JP-A-59-83154, JP-A-59-178451, JP-A-59-178452, JP-A-59-178453, JP-A-59-178454, JP-A-59-178455 and JP-A-59-178457, are sometimes employed for preparing emulsified dispersions which contain compounds which are represented by formula (1) and reducible dye donating compounds. Alternatively, methods in which a solution is prepared in an organic solvent of a boiling point from about 30° C. to 160° C., such as ethyl acetate, sec-butyl alcohol, methyl isobutyl ketone, β-ethoxyethyl acetate, methylcellosolve acetate or cyclohexanone for example and then this solution is dispersed in a hydrophilic colloid, are employed. Furthermore, after dispersion, the low boiling point solvent can be removed, as required, using ultra-filtration for example. Hydrophobic additives such as reducing agents which are fast to diffusion and electron donors which are described hereinafter can be included in an emulsified dispersion of the present invention. In the present invention, the amount of the abovementioned high boiling point organic solvent is preferably not more than 10 grams, and most desirably not more than 5 grams, per gram of the dye donating compound which is being used.

The thermally developable photosensitive materials according to the present invention basically have a photosensitive silver halide, a binder, an electron donor, an electron transfer agent and a reducible dye donating compound on a support, and they can also contain organometallic salt oxidizing agents and such like compounds as required.

These components are often added to the same layer, but if they are in a reactive state they can also be divided and added to separate layers. For example, there is a disadvantage in that the photographic speed is reduced if a colored-dye donating compound is present in a lower layer of silver halide emulsion. The incorporation of a reducing agent into a thermally developable photosensitive material is desirable, but it may be provided externally using a method in which it diffuses from a dye fixing element, for example, as will be described hereinafter.

A combination of at least three silver halide emulsion layers which are photosensitive to different spectral regions is used in order to obtain a wide range of colors in the chromaticity diagram using the three primary colors yellow, magenta and cyan. For example there are three-layer combinations consisting of a blue-sensitive layer, a green-sensitive layer and a red-sensitive layer, and combinations a green-sensitive layer, a red-sensitive layer and an infrared-sensitive layer. The various sequential arrangements which are known in the ordinary types of color photosensitive material can be adopted for these photosensitive layers. Furthermore, each of these photosensitive layers may be divided into two or more layers, as required.

Various supplementary layers, such as protective layers, subbing layers, intermediate layers, yellow filter layers, antihalation layers and backing layers, for example, can be established in the thermally developable photosensitive material.

Any silver halide, including silver chloride, silver bromide, silver iodobromide, silver chlorobromide, silver chloroiodide and silver chloroiodobromide, can be used in the present invention.

The silver halide emulsions used in the present invention may be surface latent image type emulsions or internal latent image type emulsions. Internal latent image type emulsions are combined with nucleating agents or fogging by light and used as direct reversal emulsions. Furthermore, so-called core/shell emulsions which have different phases for the interior of the grain and for the grain surface layer can also be used. The silver halide emulsion may be monodisperse or polydisperse, and mixtures of monodisperse emulsions can be used. The grain size is preferably from 0.1 to 2 μm, and most preferably from 0.2 to 1.5 μm. The crystal habit of the silver halide grains may be cubic, tetradecahedral, tabular with a high aspect ratio or of some other form.

In practice, any of the silver halide emulsions disclosed, for example, in column 50 of U.S. Pat. No. 4,500,626, U.S. Pat. No. 4,628,021, *Research Disclosure* (referred to hereinafter as RD) 17029 (1978), JP-A-62-253159, JP-A-3-110555, JP-A-2-236546 and JP-A-1-167743 can be used.

The silver halide emulsions can be used without post-ripening, but they are generally chemically sensitized for use. The known methods of sulfur sensitization, reduction sensitization, precious metal sensitization and selenium sensitization, for example, can be used individually or in combinations with emulsions for normal type photosensitive element purposes. These methods of chemical sensitization can also be carried out in the presence of nitrogen containing heterocyclic compounds (JP-A-62-253159).

The coated weight of photosensitive silver halide used in the present invention is within the range from 1 mg to 10 grams per square meter, calculated as silver.

In the present invention, organometallic salts can be used as oxidizing agents conjointly with the photosensitive silver halides. The use of organic silver salts from among these organometallic salts is especially desirable.

The benzotriazoles, fatty acids and other compounds disclosed, for example, in columns 52–53 of U.S. Pat. No. 4,500,626 can be used as organic compounds for forming the above mentioned organic silver salt oxidizing agents. Furthermore, the silver salts of carboxylic acids which have alkynyl groups, such as the silver phenylpropiolate disclosed in JP-A-60-113235, and the silver acetylenes disclosed in JP-A-61-249044, can also be used. Two or more types of organic silver salts can be used conjointly.

The above mentioned organic silver salts can be used conjointly in amounts of from 0.01 to 10 mols, and preferably of from 0.01 to 1 mol, per mol of photosensitive silver halide. The total coated weight of photosensitive silver halide and organic silver salt is suitably from 50 mg to 10 grams per square meter when calculated as silver.

Various antifoggants or photographic stabilizers can be used in the present invention. For example, use can be made of the azoles and azaindenes disclosed on pages 24–25 of RD 17643 (1978), the nitrogen containing carboxylic acids and phosphoric acids disclosed in JP-A-59-168442 or the mercapto compounds and their metal salts disclosed in JP-A-59-111636 and JP-A-4-73649 and the acetylene compounds disclosed in JP-A-62-87957 and JP-A-4-255845.

The silver halides which are used in the present invention may be spectrally sensitized with methine dyes or with other dyes. The dyes which can be used include cyanine dyes, merocyanine dyes, complex cyanine dyes, complex merocyanine dyes, holopolar cyanine dyes, hemicyanine dyes, styryl dyes and hemioxonol dyes.

Specific examples include the sensitizing dyes disclosed, for example, in U.S. Pat. No. 4,617,257, JP-A-59-180550, JP-A-60-140335 and RD 17029 (1978), pages 12–13.

These sensitizing dyes can be used individually, or combinations of these dyes can be used. Combinations of sensitizing dyes are often used in particular with a view to achieving supersensitization.

Compounds which exhibit supersensitization, which is to say dyes which themselves have no spectrally sensitizing action or compounds which essentially do not absorb visible light (for example, those disclosed in U.S. Pat. No. 3,615,641 and JP-A-63-23145), may be included in the emulsion together with the sensitizing dyes.

These sensitizing dyes may be added to the emulsion before, during or after chemical ripening, and they may be added before or after forming the nuclei of the silver halide grains as disclosed in U.S. Pat. Nos. 4,183,756 and 4,225,666. The amount added is generally of the order on from $10^{-8}$ to $10^{-2}$ mol per mol of silver halide.

The use of a hydrophilic binder for the binder of the structural layers of the photosensitive materials and dye fixing materials is preferred. Examples of those binders are disclosed on pages (26)–(28) of JP-A-62-253159. In practical terms, transparent or translucent hydrophilic binders are preferred, and examples of these binders include proteins such as gelatin and gelatin derivatives and other natural compounds such cellulose derivatives and polysaccharides such as starch, gum arabic, dextran and pullulan, and poly(vinyl alcohol), polyvinylpyrrolidone, acrylamide polymers and other synthetic polymeric compounds. Furthermore, the highly water absorbent polymers disclosed, for example, in JP-A-62-245260, which is to say homopolymers of vinyl monomers which have a —COOM group or an —$SO_3M$ group (where M represents a hydrogen atom or an alkali metal) or copolymers of these vinyl monomers, or copolymers of these vinyl monomers with other vinyl monomers (for example, sodium methacrylate, ammonium methacrylate, Sumikagel L-5H made by the Sumitomo Chemical Co.), can also be used. Two or more of these binders can also be used in combination.

In cases where a system is used in which a trace amount of water is supplied and thermal development is carried out is used it is possible by using the polymers which have a high water absorbing capacity described above to achieve rapid water absorption. Furthermore, when a polymer which has a high water absorbing capacity is used in a dye fixing layer or in a dye fixing layer protective layer, it is possible to prevent the retransfer a of dye from a dye fixing element to another element once transfer has been accomplished.

The coated weight of binder in the present invention is preferably not more than 20 grams per square meter, more desirably not more than 10 grams per square meter, and most desirably not more than 7 grams per square meter.

Various polymer latexes can be included in the structural layers (including the backing layers) of a photosensitive material or a dye fixing element with a view to improving film properties, which is to say for providing dimensional stabilization, preventing the occurrence of curl, preventing the occurrence of sticking, preventing the formation of cracks in the film and preventing the occurrence of pressure sensitization and desensitization. Specific examples include all of the polymer latexes disclosed, for example, in JP-A-62-245258, JP-A-62-136648 and JP-A-62-110066. In particular, it is possible to prevent cracking of a mordant layer if a polymer latex which has a low glass transition point (not more than 40° C.) is used in the mordant layer, and an anti-curl effect can be realized by using a polymer latex which has a high glass transition point in a backing layer.

Examples of electron donors which can be used in this invention include the electron donors and electron donor precursors disclosed, for example, in columns 49–50 of U.S. Pat. No. 4,500,626, columns 30–31 of U.S. Pat. No. 4,483,914, U.S. Pat. Nos. 4,330,617 and 4,590,152, pages (17)–(18) of JP-A-60-140335, JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256, and pages 78–96 of European Patent 220746A2.

Combinations of various electron donors such as those disclosed in U.S. Pat. No. 3,039,869 can also be used.

Electron transfer agents or precursors thereof can be selected from among the aforementioned electron donors and precursors thereof. The electron transfer agent or precursor thereof preferably has a higher mobility than the non-diffusible electron donor. 1-Phenyl-3-pyrazolidones and aminophenols are especially useful electron transfer agents.

The electron donors which are fast to diffusion and which are used in combination with electron transfer agents should be those from among the aforementioned reducing agents which are essentially immobile in the layers of the photosensitive material, and the hydroquinones, sulfonamidophenols, sulfonamidonaphthols and the compounds disclosed as electron donors in JP-A-53-110827 can be cited as preferred examples.

The total amount of electron donor and electron transfer agent added in the present invention is from 0.01 to 20 mols, and most desirably from 0.1 to 10 mols, per mol of silver.

The reducible dye donating compounds in the present invention are nondiffusible compounds which react with reducing agents which remain unoxidized by development and release diffusible dyes as disclosed, for example, in U.S. Pat. No. 4,559,290, European Pat. No. 220746A2, U.S. Pat. No. 4,783,396 and Kokai Giho 87-6199.

Examples include the compounds which release diffusible dyes by means of an intramolecular nucleophilic displacement reaction after reduction disclosed, for example, in U.S. Pat. Nos. 4,139,389 and 4,139,379, JP-A-59-185333 and JP-A-57-84453, the compounds which release a diffusible dye by means of an intramolecular electron transfer reaction after reduction disclosed, for example, in U.S. Pat. No. 4,232,107, JP-A-59-101649, JP-A-61-88257 and RD 24025 (1984), the compounds which release a diffusible dye via single bond cleavage after reduction disclosed, for example, in West German Patent 3,008,588A, JP-A-56-142530, and U.S. Pat. Nos. 4,343,893 and 4,619,884, the nitro compounds which release diffusible dyes after accepting an electron disclosed, for example, in U.S. Pat. No. 4,450,223, and the compounds which release diffusible dyes after accepting an electron disclosed, for example, in U.S. Pat. No. 4,609,610.

More preferably these dye donating compounds are the compounds which have electron withdrawing groups and N—X bonds (where X represents an oxygen, sulfur or nitrogen atom) within the molecule disclosed, for example, in European Patent 220746A2, Kokai Giho 87-6199, U.S. Pat. No. 4,783,396, JP-A-63-201653 and JP-A-63-201654, the compounds which have electron withdrawing groups and $SO_2$—X bonds (where X has the same significance as described above) within the molecule disclosed in JP-A-1-26842, the compounds which have electron withdrawing groups and PO—X bonds (where X has the same significance as described above) within the molecule as disclosed in JP-A-63-271344 and the compounds which have electron withdrawing groups and a C–X′ bond (where X′ is the same as X or —$SO_2$—) disclosed in JP-A-63-271341. Furthermore, the compounds which release diffusible dyes on the cleavage of a single bond after reduction by means of a $\pi$-bond which is conjugated with an electron accepting group disclosed in JP-A-1-161237 and JP-A-1-161342 can also be used.

From among these compounds, those which have electron withdrawing groups and N—X bonds within the molecule are especially preferred. Actual examples include Compounds (1)–(3), (7)–(10), (12), (13), (15), (23)–(26), (31), (32), (35), (36), (40), (41), (44), (53)–(59), (64) and (70) disclosed in U.S. Pat. No. 4,783,396 and in European Patent 220746A2, and Compounds (11)–(23) disclosed in Kokai Giho 87–1699.

Development inhibitor releasing redox compounds can be used to produce an improved color reproduction in the present invention. For example, use can be made of those disclosed in JP-A-61-213847, JP-A-62-260153, JP-A-2-68547, JP-A-2-110557, JP-A-2-253253 and JP-A-1-150135.

Methods for the preparation of development inhibitor releasing redox compounds which can be used in the present invention have been disclosed, for example, in JP-A-61-213847, JP-A-62-260153, U.S. Pat. No.

4,684,604, JP-A-1-269936, U.S. Pat. Nos. 3,379,529, 3,620,746, 4,377,634 and 4,332,878, JP-A-49-129536, JP-A-56-153336 and JP-A-56-153342.

The development inhibitor releasing redox compounds of the present invention are used in amounts preferably within the range $1\times10^{-6}$–$5\times10^{-2}$ mol, and more preferably within the range $1\times10^{-5}$–$1\times10^{-2}$ mol, per mol of silver halide. The development inhibitor releasing redox compounds which are used in the present invention can be used by dissolution in appropriate water miscible organic solvents, such as alcohols (methanol, ethanol, propanol, fluorinated alcohol), ketones (acetone, methyl ethyl ketone), dimethylformamide, dimethylsulfoxide or methylcellosolve for example.

Furthermore, these redox compounds can be dissolved in accordance with the well known emulsification and dispersion method in an oil such as dibutyl phthalate, tricresyl phosphate, glyceryl triacetate or diethyl phthalate using an auxiliary solvent such as ethyl acetate or cyclohexanone for example and then formed mechanically into an emulsified dispersion for use. Alternatively, a development inhibitor releasing redox compound powder can be dispersed in water using a ball mill, a colloid mill or ultrasonics in accordance with the methods well known for making a solid dispersion.

A thermally developable color photosensitive material of the present invention may contain at least one type of dextran, pullulan or their derivatives.

Dextran and pullulan are types of polysaccharide, being polymers of D-glucose. The dextran which is used in the invention preferably has a molecular weight of 20,000–2,000,000, and most preferably it has a molecular weight of 100,000–800,000. A pullulan of molecular weight.20,000–2,000,000 is preferred. Those derivatives in which sulfinic acid groups or amino groups for example have been introduced into the dextran or pullulan and which can react easily with film hardening agents can be cited as dextran and pullulan derivatives.

Dextran, pullulan and their derivatives can be used individually, or two or more types may be used conjointly.

The layer which contains dextran, pullulan or their derivatives may be any layer of the thermally developable photosensitive material, but inclusion in an intermediate layer or a protective layer is preferred.

The amount of dextran, pullulan and their derivatives used is within the range 0.01–10 g/m$^2$, and preferably within the range 0.05–5 g/m$^2$. This use range is set because with less than 0.01 g/m$^2$ the effect of the invention is lost, while conversely when the amount exceeds 10 g/m$^2$ the film quality deteriorates.

The methods of dispersion with polymers disclosed in JP-B-51-39853 and JP-A-51-59943 can also be used, as well as the methods in which hydrophobic additives such as electron donors and reducing agents which are fast to diffusion are emulsified using the same high boiling point organic solvent with the compound represented by formula (1) or the reducible dye donating compound. (The term "JP-B" as used herein signifies an "examined. Japanese patent publication".)

Compounds which are essentially insoluble in water can be included by dispersion as fine particles in the binder as well as using the methods described above.

Various surfactants can be used when dispersing hydrophobic compounds in a hydrophilic colloid. For example, use can be made of the surfactants disclosed on pages (37)–(38) of JP-A-59-157636.

Compounds which activate development and at the same time stabilize the image can be used in the photosensitive material in the present invention. Actual examples of compounds whose use is preferred have been disclosed in columns 51–52 of U.S. Pat. No. 4,500,626.

A dye fixing element is used together with the photosensitive material in a system in which the image is formed by the diffusion transfer of dyes. The dye fixing element may be of a form in which it is established on a separate support from the photosensitive material, or it may have a form in which it is established by coating on the same support as the photosensitive material. The relationship between the photosensitive material and the dye fixing element, the relationship with the support and the relationship with a white reflecting layer disclosed in column 57 of U.S. Pat. No. 4,500,626 can be adopted in this application.

The dye fixing elements preferably used in the present invention have at least one layer which contains a mordant and a binder. The mordants known in the photographic field can be used for the mordant, and actual examples include the mordants disclosed in columns 58–59 of U.S. Pat. No. 4,500,626 and on pages (32)–(41) of JP-A-61-88256, and those disclosed in JP-A-62-244043 and JP-A-62-244036. Furthermore, dye accepting polymer compounds such as those disclosed in U.S. Pat. No. 4,463,079 can also be used.

Auxiliary layers such as protective layers, peel layers, anti-curl layers and the like can be established, as required, in the dye fixing element. The establishment of a protective layer is especially useful.

High boiling point organic solvents can be used as plasticizers, slip agents or as agents for improving the peeling properties of the photosensitive material and the dye fixing element in the structural layers of the photosensitive materials and dye fixing elements. In practice, use can be made of those disclosed, for example, on page (25) of JP-A-62-253159 and in JP-A-62-245253.

Moreover, various silicone oils (all of the silicone oils ranging from dimethylsilicone oil to the modified silicone oils in which various organic groups have been introduced into dimethylsiloxane) can be used for the purposes mentioned above. As an example, various modified silicone oils described in the technical data sheet P6–18B, "Modified Silicone Oils", put out by the Shinetsu Silicone Co., and especially the carboxy modified silicone (trade name X-22-3710) for example, are effective.

Furthermore, the silicone oils disclosed in JP-A-62-215953 and JP-A-63-46449 are also effective.

Anti-color fading agents may be used in the photosensitive materials and dye fixing elements. Antioxidants, ultraviolet absorbers and certain types of metal complex can be used, for example, as anti-color fading agents.

Examples of compounds which are effective as antioxidants include chroman based compounds, coumaran based compounds, phenol based compounds (for example, hindered phenols), hydroquinone derivatives, hindered amine derivatives and spiroindane based compounds. Furthermore, the compounds disclosed in JP-A-61-159644 are also effective.

Compounds such as benzotriazole based compounds (for example, in U.S. Pat. No. 3,533,794), 4-thiazolidone based compounds (for example, in U.S. Pat. No. 3,352,681), benzophenone based compounds (for example, in JP-A-46-2784) and the other compounds disclosed, for example, in JP-A-54-48535, JP-A-62-136641 and JP-A-61-88256 can be used as ultraviolet absorbers. Furthermore, the ultraviolet absorbing polymers disclosed in JP-A-62-260152 are also effective.

The compounds disclosed, for example, in U.S. Pat. No. 4,241,155, columns 3–36 of U.S. Pat. No. 4,245,018, columns 3–8 of U.S. Pat. No. 4,254,195, JP-A-62-174741, pages (27)–(29) of JP-A-61-88256, JP-A-63-199248, JP-A-1-75568 and JP-A-1-74272 can be used as metal complexes.

Examples of useful anti-color fading agents have been disclosed on pages (125)–(137) of JP-A-62-215272.

Anti-color fading agents for preventing the fading of dyes which have been transferred to a dye fixing element may be included beforehand in the dye fixing element, or they may be supplied to the dye fixing element from the outside, from the photosensitive material for example.

The abovementioned antioxidants, ultraviolet absorbers and metal complexes may be used in combinations of each type.

Fluorescent whiteners may be used in the photosensitive materials and dye fixing elements. The fluorescent whiteners are preferably incorporated into the dye fixing element or supplied to the dye fixing element from the outside, from the photosensitive element for example. As an example, the compounds disclosed, for example, in chapter 8 of volume V of *The Chemistry of Synthetic Dyes,* by K. Veenkataraman, and JP-A-61-143752, can be used. In more practical terms, use can be made, for example, of stilbene based compounds, coumarin based compounds, biphenyl based compounds, benzoxazolyl based compounds, naphthalimide based compounds, pyrazoline based compounds and carbostiryl based compounds.

Fluorescent whiteness can be used in combination with anti-color fading agents.

The film hardening agents disclosed, for example, in column 41 of U.S. Pat. No. 4,678,739, JP-A-59-116655, JP-A-62-245261 and JP-A-61-18942 can be used as the film hardening agents which are used in the structural layers of photosensitive materials and dye fixing elements. In more practical terms, use can be made of aldehyde based film hardening agents (formaldehyde for example), aziridine based film hardening agents, epoxy based film hardening agents, vinylsulfone based film hardening agents (N,N'-ethylene-bis(vinylsulfonylacetamido)ethane for example), N-methylol based film hardening agents (dimethylolurea for example), and polymeric film hardening agents (the compounds disclosed, for example, in JP-A-62-234157). Use of the vinylsulfone based film hardening agents disclosed in JP-A-H3-114043 is especially preferred.

Various surfactants can be used in the structural layers of the photosensitive materials and dye fixing elements as coating promotors, for improving peelability, for improving slip properties, for antistatic purposes or for accelerating development for example. Actual examples of surfactants have been disclosed, for example, in JP-A-62-173463 and JP-A-62-183457.

Organic fluoro compounds may be included in the structural layers of the photosensitive materials and dye fixing elements with a view to improving slip properties, for antistatic purposes or for improving peeling properties for example. Typical examples of organic fluoro compounds include the fluorine based surfactants disclosed, for example, in columns 8–17 of JP-B-57-9053, JP-A-61-20944 and JP-A-62-135826, and the oily fluorine based compounds such as fluorine oil and the hydrophobic fluorine compounds including solid fluorine compound resins such as ethylene tetrafluoride resins.

Matting agents can be used in the photosensitive materials and dye fixing elements. In addition to compounds such as silicon dioxide and polyolefin or the polymethacrylates disclosed on page 29 of JP-A-61-88256 for example, the compounds disclosed in JP-A-63-274944 and JP-A-63-274952, such as benzoguanamine resin beads, polycarbonate resin beads and AS resin beads, for example, can be used as matting agents.

Furthermore, thermal solvents, antifoaming agents, antimolds and fungicides, and colloidal silica, for example, may be included in the photosensitive materials and dye fixing elements. Actual examples of these additives have been disclosed on pages (26)–(32) of JP-A-61-88256.

Image forming accelerators can be used in the photosensitive materials and/or dye fixing elements in the present invention. Image forming accelerators are compounds which function in such a way as to accelerate the redox reaction of silver salt oxidizing agents and reducing agents, to accelerate the reaction which produces a dye, to break down the dye or release a diffusible dye from the dye donating substance, and to accelerate the migration of the dye from the photosensitive material to the dye fixing layer. On the basis of their physico-chemical function they can be classified as bases or base precursors, nucleophilic compounds, high boiling point organic solvents (oils), thermal solvents, surfactants, and compounds which interact with silver or silver ion, for example. However, these groups of substances generally have a complex function and they usually involve a combination of a number of the above mentioned accelerating effects. Details have been disclosed in columns 38–40 of U.S. Pat. No. 4,678,739.

Salts of bases with organic acids which decarboxylate on heating, and compounds which undergo an intramolecular nucleophilic substitution reaction and release amines by way of a Lossen rearrangement or a Beckmann rearrangement are examples of base precursors. Actual examples have been disclosed, for example, in U.S. Pat. No. 4,511,493 and JP-A-62-65038.

In systems where thermal development and dye transfer are carried out simultaneously in the presence of a small quantity of water, the inclusion of the base and/or base precursor in the dye fixing element is preferred in the sense that it improves the storage properties of the photosensitive material.

Combinations of sparingly soluble metal compounds and compounds which can undergo a complex-forming reaction with the metal ions from which the sparingly soluble metal compounds are constituted (known as complex-forming compounds) as disclosed in European Patent laid-open 210,660 and U.S. Pat. No. 4,740,445 are used in the present invention. Actual examples have been disclosed on pages (2)–(6) of JP-A-2-269338. Zinc hydroxide, zinc oxide and mixtures of zinc hydroxide and zinc oxide are especially desirable as sparingly water soluble compounds.

Various development terminators can be used in the photosensitive materials and/or dye fixing elements in the present invention with a view to obtaining in general a constant image irrespective of fluctuations in the processing temperature and the processing time during development.

Here, the term "development terminator" signifies a compound which, after proper development, rapidly neutralizes the base or reacts with the base, reduces the base concentration in the film and terminates development, or a compound which interacts with silver and silver salts and inhibits development. In practice, these compounds include acid precursors which release an acid on heating, electrophilic compounds which undergo substitution reactions with bases which are present on heating, and nitrogen containing heterocyclic compounds, mercapto compounds and precursors of these compounds. Further details have been disclosed on pages ( 31 ) to ( 32 ) of JP-A-62-253159.

Those supports which can withstand the processing temperature can be used as the supports for the photosensitive materials and dye fixing elements in the present invention. Paper and synthetic polymers (films) are generally used. In practice, use can be made of supports comprised of poly(ethylene terephthalate.), polycarbonate, poly(vinyl chloride), polystyrene, polypropylene, polyimide, cellulose derivatives (for example, triacetyl cellulose), or supports wherein a pigment such as titanium oxide is included within these films, film type .synthetic papers made from polypropylene for example, mixed papers made from a synthetic resin pulp, such as polyethylene pulp and natural pulp, Yankee paper, baryta paper, coated papers (especially cast coated papers), metals, cloths and glasses for example.

These supports can be used individually, and supports which have been laminated on one side or on both sides with a synthetic polymer such as polyethylene for example can also be used.

The supports disclosed on pages (29)–(31) of JP-A-62-253159 can also be used.

Hydrophilic binder and a semiconductive metal oxide such as tin oxide or alumina sol, carbon black, and other antistatic agents may be coated on the surface of these supports.

The methods which can be used for exposing and recording an image on the photosensitive materials include those in which the picture of a scene or a person, for example, is taken directly using a camera for example, methods in which an exposure is made through a reversal film or a negative film using a printer or an enlarger, methods in which a scanning exposure of an original is made through a slit using the exposing device of a copying machine for example, methods in which the exposure is made with light emitted from a light emitting diode or various types of laser, being controlled by an electrical signal in accordance with picture information, and methods in which exposures are made directly, or via an optical system, using image information which is being put out using an image display device such as a CRT, a liquid crystal display, an electroluminescent display or plasma display, for example, for realizing the image information.

As indicated above, natural light, tungsten lamps, light emitting diodes, laser light sources and CRT light sources, for example, the light sources disclosed in column 56 of U.S. Pat. No. 4,500,626, can be used as light sources for recording images on the photosensitive material.

Furthermore, imagewise exposures can also be made using wave-length conversion elements in which a non-linear optical material is combined with a coherent light source such as laser light for example. Here, a non-linear optical material is a material which is such that when irradiated with a strong photoelectric field such as laser light it exhibits a non-linearity between the apparent polarization and the electric field. Inorganic compounds as typified by lithium niobate, potassium dihydrogen phosphate (KDP), lithium iodate and $BaB_2O_4$, and urea derivatives, nitroaniline derivatives, nitropyridine-N-oxide derivatives such as 3-methyl-4-nitropyridine-N-oxide (POM) for example, and the compounds disclosed in JP-A-61-53462 and JP-A-62-210432 are preferably used for this purpose. Any of the known embodiments of wavelength converting elements such as the single crystal optical wave guide type and the fibre type can be used.

Furthermore, the aforementioned image information may be an image signal which has been obtained using a video camera or an electronic still camera for example, a television signal as typified by the Japanese television signal specification (NTSC), an image signal obtained by dividing an original into a plurality of picture elements using a scanner for example, or an image signal which has been generated using a computer, as typified by CG and CAD for example.

The photosensitive material and/or dye fixing element may be an embodiment which has an electrically conductive heat generating layer as a means of heating for thermal development purposes or for the diffusion transfer of dyes. In such a case a transparent or opaque heat generating element as disclosed in JP-A-61-145544 can be used. Moreover, these electrically conductive layers also function as an antistatic layer.

Development is possible on heating to a temperature of from about 50° C. to about 250° C. in the thermal development process, but heating temperatures of from about 80° C. to about 180° C. are especially useful. A dye diffusion transfer process may be carried out at the same time as thermal development, or it may be carried out after completion of the thermal development process. In the latter case, transfer is possible with heating temperatures for the transfer process within the range from the temperature during the thermal development process to room temperature, but temperatures of at least 50° C. and up to about 10° C. lower than the temperature during the thermal development process are preferred.

Dye transfer can be achieved by heat alone, but solvents may be used in order to promote dye transfer. Furthermore, the methods in which development and transfer are carried out simultaneously or continuously by heating in the presence of a small amount of solvent (especially water) as described in detail in JP-A-59-218443 and JP-A-61-238056 are also useful. In these methods the heating temperature is preferably at least 50° C. but not more than the boiling point of the solvent. For example, when water is used for the solvent a temperature of at least 50° C., but not more than 100° C. is desirable Water or a basic aqueous solution which contains an inorganic alkali metal salt or an organic base (the bases disclosed in the section on image forming accelerators can be used for the base) can be cited as examples of solvents which can be used to accelerate development and/or transfer a diffusible dye into a dye fixing layer. Furthermore, low boiling point solvents or mixtures of low boiling point solvents with water or basic aqueous solutions, for example, can also be used. Furthermore, surfactants, antifoggants, and sparingly soluble metal salts and complex-forming compounds, for example, may be included in the solvent.

These solvents may be applied to a dye fixing element, to a photosensitive material or to both of these elements for use. The amount used should be small, being less than the weight of solvent corresponding to the maximum swelled volume of the whole coated film (in particular, not more than the amount obtained on subtracting the weight of the whole coated film from the weight of solvent corresponding to the maximum swelled volume of the whole coated film).

The method described on page (26) of JP-A-61-147244 can be used, for example, for applying the solvent to a photosensitive layer or a dye fixing layer. Furthermore, the solvent can also be incorporated for use into the photosensitive material, the dye fixing element or both of these elements beforehand in a form in which it has been enclosed by micro-encapsulation.

Furthermore, methods in which a hydrophilic thermal solvent which is a solid at normal temperature but which melts at elevated temperatures is incorporated in to the photosensitive material or the dye fixing element can also be adopted for accelerating dye transfer. The hydrophilic thermal solvent may be incorporated into the photosensitive material or into the dye fixing element, or it may be incorporated into both of these elements. The layer into which it is incorporated may be an emulsion layer, an intermediate layer, a protective layer or a dye fixing layer, but it is preferably incorporated into a dye fixing layer and/or a layer adjacent thereto.

Examples of hydrophilic thermal solvents include ureas, pyridines, amides, sulfonamides, imides, alcohols, oximes and other heterocyclic compounds.

Furthermore, high boiling point organic solvents may be included in the photosensitive material and/or dye fixing element in order to accelerate dye transfer.

Sometimes the material is brought into contact with a heated block or plate, sometimes the material is brought into contact with a hot plate, a hot presser, a heated roller, a halogen lamp heater or an infrared or far-infrared lamp heater for example, and sometimes the material is passed through a high temperature atmosphere as the means of heating in the development and/or transfer process.

The method in which the photosensitive material and the dye fixing element are brought together and pressed under the pressing conditions while in contact disclosed on page 27 of JP-A-61-147244 can be used.

Any of the various thermal development devices can be used for processing a photographic element of the present invention. For example, use of the devices disclosed, for example, in JP-A-59-75247, JP-A-59-177547, JP-A-59-181353, JP-A-60-18951, JP-A-U-62-25944, JP-A-3-131856 and JP-A-3-131851 is preferred. (The term "JP-A-U" as used herein signifies an "unexamined published Japanese utility model application".)

The invention is described by means of an illustrative example below, but the invention is not limited by this example.

EXAMPLE 1

The method for the preparation of a dispersion of zinc hydroxide is described below.

Zinc hydroxide of an average particle size 0.2 μm (12.5 grams), 1 gram of carboxymethylcellulose as a dispersant and 0.1 gram of poly(sodium acrylate) were added to 100 ml of 4% aqueous gelatin solution. The mixture was pulverized for 30 minutes using glass beads of an average diameter 0.75 mm in a mill. The glass beads were removed and a dispersion of zinc hydroxide was obtained.

The method for the preparation of a dispersion of an electron transfer agent is described below.

The electron transfer agent indicated below (10 grams), 0.5 gram of polyethyleneglycol nonylphenyl ether a as dispersant and 0.5 gram of the anionic surfactant (1) indicated below were added to a 5% aqueous gelatin solution and pulverized for 60 minutes using glass beads of average diameter 0.75 mm in a mill. The glass beads were then removed and a dispersion of the electron transfer agent of an average particle size 0.35 μm was obtained.

Electron Transfer Agent

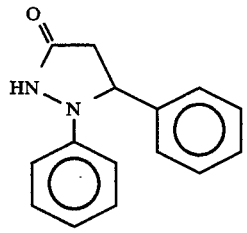

Anionic Surfactant (1)

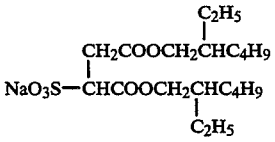

The method for the preparation of a dye trapping agent dispersion is described below.

A liquid mixture comprising of 108 ml of the polymer latex indicated below (solid contents 13%), 20 grams of the surfactant (1) indicated below and 1,232 ml of water was agitated and 600 ml of a 5% aqueous solution of the anionic surfactant (2) indicated below was added over a period of 10 minutes. The dispersion obtained in this way was concentrated to 500 ml and de-salted using an ultrafiltration module. Next 1500 ml of water was added and the same procedure was repeated once again and 500 grams of a dye trapping dispersion was obtained.

Polymer Latex

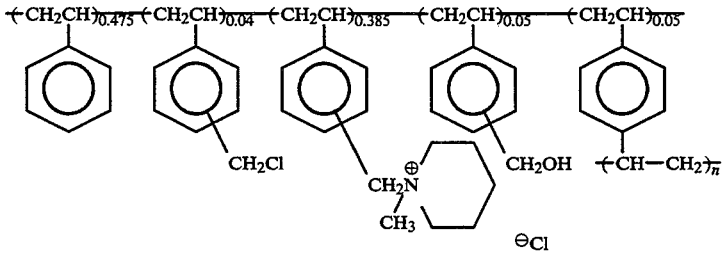

-continued

Surfactant (1)

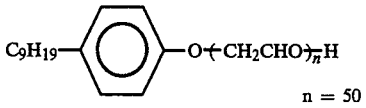

n = 50

Anionic Surfactant (2)

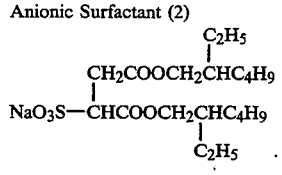

The method for the preparation of a gelatin dispersion of hydrophobic additives is described below.

Gelatin dispersions Cyan-1, Magenta-1, Yellow-1 containing cyan, magenta and yellow dye donating compounds, respectively, were prepared in accordance with the formulations indicated in Table 1. That is, each of the components for an was oil-phase dissolved by heating to about 60° C. to form a uniform solution and the components for an aqueous-phase which had been heated to about 60° C. were added to this solution. After being mixed thoroughly, the mixture was dispersed for 13 minutes at 12,000 rpm in a homogenizer. Water was then added, the mixture was stirred, and a uniform dispersion was obtained. Moreover, with the gelatin dispersions which contained the cyan and magenta dye donating compounds, 2,500 cc of water were added to 500 grams of the dispersion and the mixture was heated to 40° C. to form a solution, after which 2,500 cc of filtrate was separated off using an ultrafiltration module.

TABLE 1

| | Cyan-1 | Magenta-1 | Yellow-1 | Electron Donor |
|---|---|---|---|---|
| Oil Phase | | | | |
| Dye Donating Compound (1) | 9.05 grams | — | — | — |
| Dye Donating Compound (2) | 6.19 grams | — | — | — |
| Dye Donating Compound (3) | — | 15.5 grams | — | — |
| Dye Donating Compound (4) | — | — | 13.0 grams | — |
| Electron Donor (1) | 4.84 grams | 5.61 grams | 4.53 grams | — |
| Electron Donor (2) | — | — | — | 13.87 grams |
| Inhibitor Releasing Redox (1) | — | — | — | 2.62 grams |
| Electron Transfer Agent Precursor | 1.42 grams | 1.42 grams | 0.86 grams | — |
| Compound (1) | 0.40 grams | 0.44 grams | 0.40 grams | — |
| Compound (1) of the invention | 3.05 grams | 3.88 grams | — | — |
| High Boiling Point Solvent (1) | 1.91 grams | 1.94 grams | 5.20 grams | — |
| High Boiling Point Solvent (2) | — | — | 3.90 ml | — |
| High Boiling Point Solvent (3) | 5.72 grams | 5.81 grams | — | 2.93 grams |
| High Boiling Point Solvent (4) | — | — | — | 2.94 grams |
| Surfactant (2) | 1.55 grams | 0.52 grams | 1.50 grams | 0.45 grams |
| Ethyl acetate | 34.5 ml | 34.5 ml | 25.0 ml | 18.0 ml |
| Methyl ethyl ketone | 47.5 ml | 47.5 ml | — | — |
| Aqueous Phase | | | | |
| Lime treated gelatin | 10.0 grams | 10.0 grams | 10.0 grams | 10.0 grams |
| Citric acid | — | — | 0.14 grams | 0.14 grams |
| Sodium bisulfite | — | — | — | 0.15 grams |
| Water Soluble Polymer (1) | 1.5 grams | 1.5 grams | — | — |
| Water Soluble Polymer (2) | — | 4.5 grams | — | — |
| Water | 150 ml | 150 ml | 120 ml | 97 ml |
| Water | 150 ml | 160 ml | 115 ml | 61 ml |

Dye Donating Compound (1)

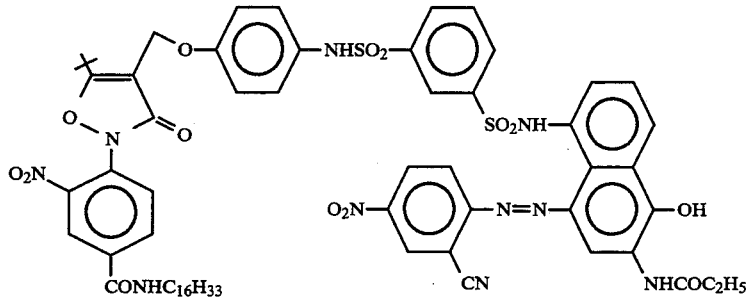

Dye Donating Compound (2)

-continued
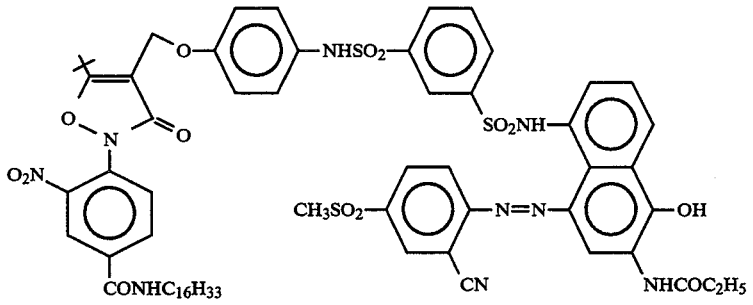
Dye Donating Compound (3)
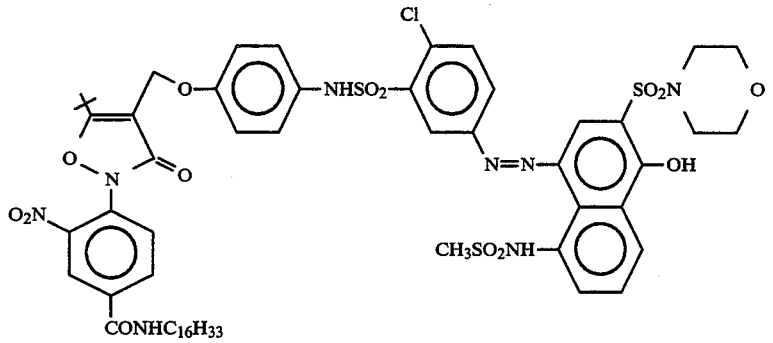
Dye Donating Compound (4)
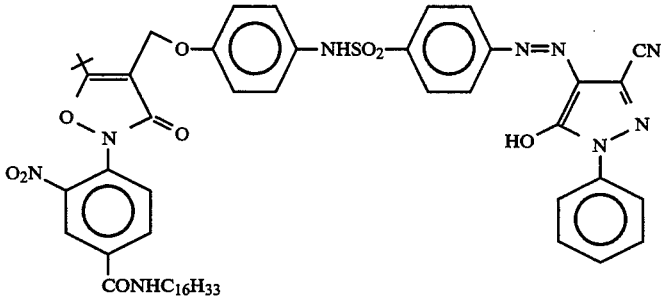
Electron Donor (1)
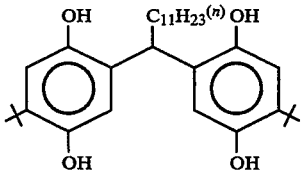
Inhibitor Releasing Redox Compound
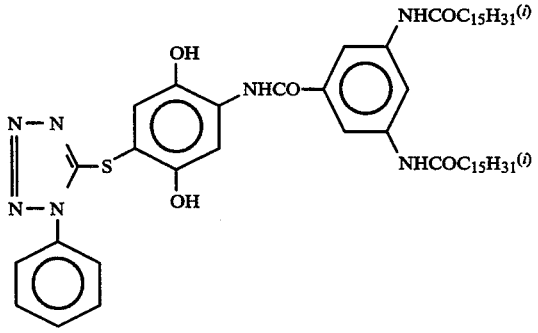
Compound (1)
Electron Donor (2)
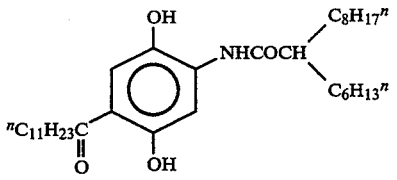
Electron Transfer Agent Precursor
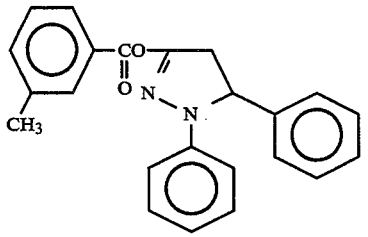
High Boiling Point Solvent (1)

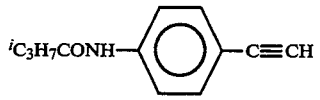

High Boiling Point Solvent (2)

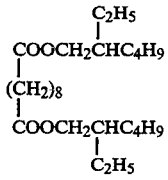

High Boiling Point Solvent (4)

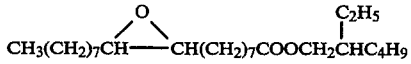

-continued

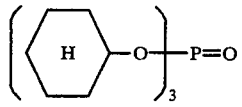

High Boiling Point Solvent (3)

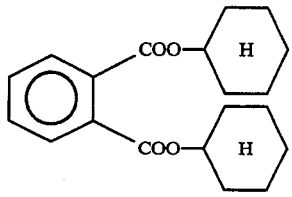

Surfactant (2)

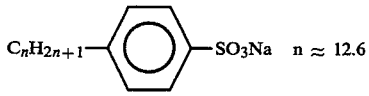

Water Soluble Polymer (1)

Poly(vinyl alcohol) 220E (made by Kuraray Co., Ltd.)

Water Soluble Polymer (2)

Serogen 6A (made by Daiichi Kogyo Kagaku Co.)

The preparation of photosensitive silver halide emulsions is described below.

Photosensitive Silver Halide Emulsion (1) (For the Red-Sensitive Emulsion Layer)

Solutions (I) and (II) shown in Table 2 were added simultaneously at an equal flow rate over a period of 20 minutes to a thoroughly agitated aqueous gelatin solution (a solution obtained by adding 20 grams of gelatin, 0.5 grams of potassium bromide, 3 grams of sodium chloride and 30 mg of the Reagent (A) indicated below to 500 ml of water and maintained at a temperature of 45° C.). After 6 minutes, Solutions (III) and (IV) shown in Table 2 were added simultaneously at an equal flow rate over a period of 25 minutes. Furthermore, an aqueous solution of a gelatin dispersion of dye (which contained 1 gram of gelatin, 70 mg of Dye (a) indicated below, 139 mg of Dye (b) indicated below and 5 mg of Dye (c) indicated below in 105 ml of water and which was being maintained at 45° C.) was added over a period of 20 minutes, starting 10 minutes after the commencement of the addition of Solutions (III) and (IV).

After washing with water and desalting in the usual way, 22 grams of lime treated ossein gelatin were added. After adjusting to the pH to 6.2 and the pAg to 7.8, 4-hydroxy-6-methyl-1,3,3a,7-tetraazaindene, and then sodium thiosulfate and chloroauric acid, were added, and chemical sensitization was carried out optimally at 68° C. Then the mixture was cooled after the addition of Antifoggant (2) indicated below. A monodisperse cubic silver chlorobromide emulsion (635 grams) of an average grain size 0.30 μm was obtained in this way.

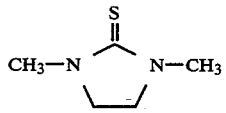

Reagent (A)

TABLE 2

| | Solution (I) | Solution (II) | Solution (III) | Solution (IV) |
|---|---|---|---|---|
| $AgNO_3$ | 50.0 grams | — | 50.0 grams | — |
| $NH_4NO_3$ | 0.19 grams | — | 0.19 grams | — |
| KBr | — | 28.0 grams | — | 35.0 grams |
| NaCl | — | 3.45 grams | — | — |
| Water to make | 250 ml | 250 ml | 200 ml | 200 ml |

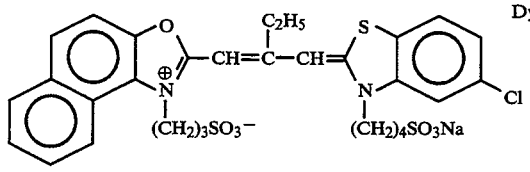

Dye (a)

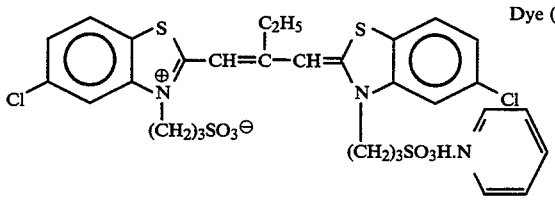

Dye (b)

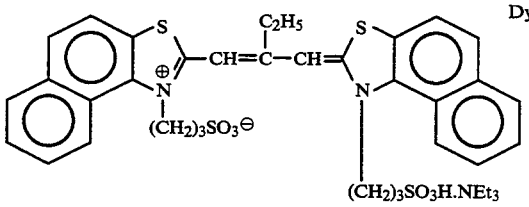

Dye (c)

Photosensitive Silver Halide Emulsion-(2) (For the Red-Sensitive Emulsion Layer)

Solutions (I) and (II) shown in Table 3 were added simultaneously at an equal flow rate over a period of 30 minutes to a thoroughly agitated aqueous gelatin solution (a solution obtained by adding 20 grams of gelatin, 0.5 grams of potassium bromide, 6 grams of sodium chloride and 30 mg of Reagent (A) indicated below to 800 ml of water and maintained at a temperature of 65° C.). After 5 minutes, Solutions (III) and (IV) shown in Table 3 were added simultaneously at an equal flow rate over a period of 15 minutes. Furthermore, an aqueous solution of a gelatin dispersion of dye (which contained 1.1 gram of gelatin, 76 mg of the aforementioned Dye (a), 150 mg of the aforementioned Dye (b) and 5 mg of aforementioned Dye (c) in 95 ml of water and which was being maintained at 50° C.) was added over a period of 18 minutes, starting 2 minutes after the commencement of the addition of Solutions (III) and (IV).

After washing with water and de-salting in the usual way, 22 grams of lime treated ossein gelatin were added. After adjusting the pH to 6.2 and the pAg to 7.8, and 4-hydroxy-6-methyl-l,3,3a,7-tetraazaindene was added, and Then sodium thiosulfate and chloroauric acid were added, chemical sensitization was carried out optimally at 68° C. Then the mixture was cooled after the addition of Antifoggant (1) indicated below. A monodisperse cubic silver chlorobromide emulsion (635 grams) of an average grain size 0.50 μm was obtained in this way.

TABLE 3

| | Solution (I) | Solution (II) | Solution (III) | Solution (IV) |
|---|---|---|---|---|
| $AgNO_3$ | 50.0 grams | — | 50.0 grams | — |
| $NH_4NO_3$ | 0.19 grams | — | 0.19 grams | — |
| KBr | — | 28.0 grams | — | 35.0 grams |
| NaCl | — | 3.45 grams | — | — |
| Water to make | 200 ml | 140 ml | 145 ml | 155 ml |

Photosensitive Silver Halide Emulsion (3) (For the Green-Sensitive Layer)

Solutions (I) and (II) shown in Table 4 were added simultaneously at an equal flow rate over a period of 8 minutes to a thoroughly agitated aqueous gelatin solution (a solution obtained by adding 20 grams of gelatin, 0.5 grams of potassium bromide, 4 grams of sodium chloride and 15 mg of the aforementioned Reagent (A) to 690 ml of water and maintaining at a temperature of 47° C.). After 10 minutes, Solutions (III) and (IV) shown in Table 4 were added simultaneously at an equal flow rate over a period of 32 minutes. Furthermore, an aqueous solution of a gelatin dispersion of a dye (which contained 2.5 grams of gelatin and 250 mg of Dye (d) indicated below in 100 ml of water, and which was being maintained at 45° C.) was added in a single shot 1 minute after completing the addition of Solutions (III) and (IV).

After washing with water and desalting in the usual way, 22 grams of lime treated ossein gelatin were added, the pH was adjusted to 6.0, the pAg was adjusted to 7.6, and 4-hydroxy-6-methyl-1,3,3a,7-tetraazaindene was added. Then sodium thiosulfate was added and chemical sensitization was carried out optimally at 68° C. Then the mixture was cooled after adding Antifoggant (1) indicated below. A monodisperse cubic chlorobromide emulsion (635 grams) of an average grain size 0.27 μm was obtained in this way.

TABLE 4

| | Solution (I) | Solution (II) | Solution (III) | Solution (IV) |
|---|---|---|---|---|
| $AgNO_3$ | 20.0 grams | — | 80.0 grams | — |
| $NH_4NO_3$ | 0.13 grams | — | 0.38 grams | — |
| KBr | — | 9.8 grams | — | 44.8 grams |
| NaCl | — | 2.06 grams | — | 5.51 grams |
| Water to make | 110 ml | 110 ml | 245 ml | 245 ml |

Dye (d)

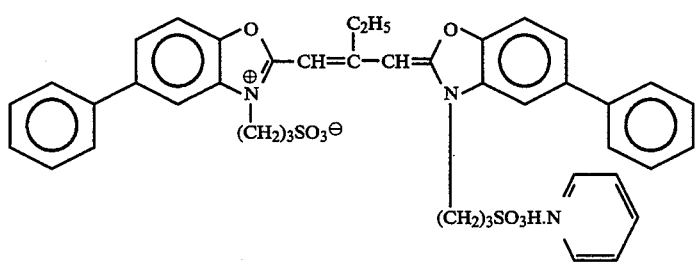

Photosensitive Silver Halide Emulsion (4) (For the Green-Sensitive Layer)

Solutions (I) and (II) shown in Table 5 were added simultaneously at an equal flow rate over a period of 20 minutes to a thoroughly agitated aqueous gelatin solution (a solution obtained by adding 20 grams of gelatin, 0.3 grams of potassium bromide, 6 grams of sodium chloride and 15 mg of the aforementioned Reagent (A) to 700 ml of water and maintaining at a temperature of 60° C.). After 10 minutes, Solutions (III) and (IV) shown in Table 5 were added simultaneously at an equal flow rate over a period of 20 minutes. Furthermore, an aqueous solution of a gelatin dispersion of dye (which contained 1.8 grams of gelatin and 180 mg of the aforementioned Dye (d) in 75 ml of water, and which was being maintained at 45° C.) was added in a single shot 1 minute after completing the addition of Solutions (III) and (IV).

After washing with water and desalting in the usual way, 22 grams of lime treated ossein gelatin were added, the pH was adjusted to 6.0, the pAg was adjusted to 7.6, and 4-hydroxy-6-methyl-1,3,3a,7-tetraazaindene was added. Then sodium thiosulfate was added and chemical sensitization was carried out optimally at 68° C. Then the mixture was cooled after adding Antifoggant (1) indicated below. A monodisperse cubic chlorobromide emulsion (635 grams) of an average grain size 0.45 μm was obtained in this way.

TABLE 5

| | Solution (I) | Solution (II) | Solution (III) | Solution (IV) |
|---|---|---|---|---|
| $AgNO_3$ | 20.0 grams | — | 80.0 grams | — |
| $NH_4NO_3$ | 0.19 grams | — | 0.38 grams | — |
| KBr | — | 9.8 grams | — | 44.8 grams |
| NaCl | — | 2.06 grams | — | 5.51 grams |
| Water to make | 165 ml | 165 ml | 205 ml | 205 ml |

Photosensitive Silver Halide Emulsion (5) (For the Blue-Sensitive Layer)

Solutions (I) and (II) shown in Table 6 were added simultaneously at an equal flow rate over a period of 8 minutes to a thoroughly agitated aqueous gelatin solution (a solution obtained by adding 20 grams of gelatin, 0.5 grams of potassium bromide, 5 grams of sodium chloride and 15 mg of the aforementioned Reagent (A) to 690 ml of water and maintaining at a temperature of 51° C.). After 10 minutes, Solutions (III) and (IV) shown in Table 6 were added simultaneously at an equal flow rate over a period of 32 minutes. Furthermore, an aqueous solution of a dye (which contained 235 mg of Dye (e) indicated below and 120 mg of Dye (f) indicated below in 95 ml of water and 5 ml of methanol, and which was being maintained at 45° C.) was added in a single shot 1 minute after completing the addition of Solutions (III) and (IV).

After washing with water and desalting in the usual way, 22 grams of lime treated ossein gelatin were added, the pH was adjusted to 6.0, the pAg was adjusted to 7.7, and 4-hydroxy-6-methyl-1,3,3a,7-tetraazaindene was added. Then sodium thiosulfate was added and chemical sensitization was carried out optimally at 68° C. and then the mixture was cooled after adding Antifoggant (1) indicated below. A monodisperse cubic chlorobromide emulsion (635 grams) of an average grain size 0.30 μm was obtained in this way.

TABLE 6

| | Solution (I) | Solution (II) | Solution (III) | Solution (IV) |
|---|---|---|---|---|
| $AgNO_3$ | 20.0 grams | — | 80.0 grams | — |
| $NH_4NO_3$ | 0.13 grams | — | 0.38 grams | — |
| KBr | — | 9.8 grams | — | 44.8 grams |
| NaCl | — | 2.06 grams | — | 5.52 grams |
| Water to make | 110 ml | 110 ml | 240 ml | 240 ml |

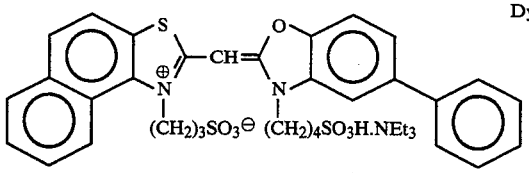

Dye (e)

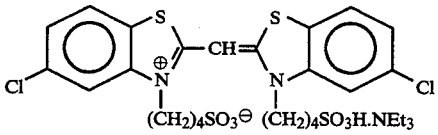

Dye (f)

Photosensitive Silver Halide Emulsion (6) (For the Blue-Sensitive Layer)

Solutions (I) and (II) shown in Table 7 were added simultaneously at an equal flow rate over a period of 10 minutes to a thoroughly agitated aqueous gelatin solution (a solution obtained by adding 20 grams of gelatin, 0.3 grams of potassium bromide, 9 grams of sodium chloride and 15 mg of the aforementioned Reagent (A) to 695 ml of water and maintaining at a temperature of 63° C.). Subsequently, after 10 minutes, Solutions (III) and (IV) shown in Table 7 were added simultaneously at an equal flow rate over a period of 30 minutes. Furthermore, an aqueous solution of a dye (which contained 155 mg of the aforementioned Dye (e) and 78 mg of the aforementioned Dye (f) in 66 ml of water and 4 ml of methanol, and which was being maintained at 60° C.) was added in a single shot 1 minute after completing the addition of Solutions (III) and (IV).

After washing with water and desalting in the usual way, 22 grams of lime treated ossein gelatin were added, the pH was adjusted to 6.0, the pAg was adjusted to 7.7, and 4-hydroxy-6-methyl-1,3,3a,7-tetraazaindene was added. Then sodium thiosulfate was added and chemical sensitization was carried out optimally at 68° C. Then the mixture was cooled after adding Antifoggant (1) indicated below. A monodisperse cubic chlorobromide emulsion (635 grams) of an average grain size 0.52 μm was obtained in this way.

TABLE 7

| | Solution (I) | Solution (II) | Solution (III) | Solution (IV) |
|---|---|---|---|---|
| $AgNO_3$ | 25.0 grams | — | 75.0 grams | — |
| $NH_4NO_3$ | 0.13 grams | — | 0.37 grams | — |
| KBr | — | 12.3 grams | — | 42.0 grams |
| NaCl | — | 2.58 grams | — | 5.18 grams |

TABLE 7-continued

| | Solution (I) | Solution (II) | Solution (III) | Solution (IV) |
|---|---|---|---|---|
| Water to make | 120 ml | 120 ml | 225 ml | 225 ml |

Photosensitive Material No.101 shown in Table 8 was prepared using these materials.

TABLE 8

The Structure of Photosensitive Material 101

| Layer Number | Layer Name | Material Added | Coated Weight (mg/m$^2$) |
|---|---|---|---|
| Seventh Layer | Protective Layer II | Acid treated gelatin | 340 |
| | | PMMA latex (size 3μ) | 20 |
| | | Colloidal silver | 0.7 |
| | | Surfactant (3) | 8 |
| | | Surfactant (5) | 2.2 |
| Sixth Layer | Protective Layer I | Lime treated gelatin | 410 |
| | | Zinc hydroxide | 440 |
| | | Electron Donor (2) | 75 |
| | | Inhibitor Releasing Redox Compound (1) | 14 |
| | | High Boiling Point Solvent (3) | 16 |
| | | High Boiling Point Solvent (4) | 16 |
| | | Surfactant (3) | 4 |
| | | Dextran | 16 |
| | | Water Soluble Polymer (3) | 1.4 |
| | | Polymer Latex (1) | 66 |
| | | Surfactant (4) | 28 |
| | | Surfactant (2) | 4.5 |
| Fifth Layer | Blue Sensitive Emulsion Layer | Photosensitive Silver Halide Emulsion (5) | 315 as silver |
| | | Photosensitive Silver Halide Emulsion (6) | 95 as silver |
| | | Dye Donating Compound (4) | 380 |
| | | Gelatin | 520 |
| | | Electron Donor (1) | 132 |
| | | Electron Transfer Agent Precursor | 25 |
| | | Compound (1) | 11.7 |
| | | High Boiling Point Solvent (1) | 152 |
| | | High Boiling Point Solvent (2) | 114 |
| | | Surfactant (2) | 44 |
| | | Antifoggant (1) | 0.9 |
| | | Water Soluble Polymer (3) | 11 |
| Fourth Layer | Intermediate Layer | Lime treated gelatin | 550 |
| | | Electron donor (2) | 159 |
| | | Inhibitor Releasing Redox Compound (1) | 30 |
| | | High Boiling Point Solvent (3) | 34 |
| | | High Boiling Point Solvent (4) | 34 |
| | | Surfactant (2) | 5.1 |
| | | Polymer Latex (1) | 88 |
| | | Electron transfer agent | 78 |
| | | Dextran | 38 |
| | | Film Hardening Agent (1) | 36 |
| | | Surfactant (4) | 26 |
| | | Water Soluble Polymer (3) | 10 |
| Third Layer | Green Sensitive Emulsion Layer | Photosensitive Silver Halide Emulsion (3) | 250 as silver |
| | | Photosensitive Silver Halide Emulsion (4) | 100 as silver |
| | | Dye Donating Compound (3) | 359 |
| | | Lime treated gelatin | 430 |
| | | Electron Donor (1) | 130 |
| | | Electron transfer agent precursor | 33 |
| | | Compound (1) | 10 |
| | | Compound (2) | 90 |
| | | High Boiling Point Solvent (1) | 45 |
| | | High Boiling Point Solvent (3) | 135 |
| | | Anti-foggant (1) | 0.8 |
| | | Water Soluble Polymer (3) | 13 |
| | | Surfactant (2) | 8 |
| Second Layer | Intermediate Layer | Lime treated gelatin | 760 |
| | | Zinc hydroxide | 812 |
| | | Electron Donor (2) | 139 |
| | | Inhibitor Releasing Redox Compound (1) | 26 |
| | | High Boiling Point Solvent (3) | 29 |
| | | High Boiling Point Solvent (4) | 29 |
| | | Surfactant (2) | 4.5 |
| | | Surfactant (3) | 5 |
| | | Dextran | 29 |
| | | Water Soluble Polymer (3) | 3.0 |
| | | Polymer Latex (1) | 122 |
| | | Surfactant (4) | 54 |
| First Layer | Red-Sensitive Emulsion Layer | Photosensitive Silver Halide Emulsion (1) | 108 as silver |
| | | Photosensitive Silver Halide Emulsion (2) | 60 as silver |
| | | Dye Donating Compound (1) | 185 |
| | | Dye Donating Compound (2) | 127 |
| | | Lime treated gelatin | 580 |

TABLE 8-continued

| | |
|---|---|
| Electron Donor (1) | 100 |
| Electron transfer agent precursor | 29 |
| Compound (1) | 8.2 |
| Compound (2) | 62 |
| High Boiling Point Solvent (1) | 39 |
| High Boiling Point Solvent (3) | 117 |
| Surfactant (3) | 21 |
| Antifoggant (1) | 0.2 |
| Antifoggant (2) | 0.3 |
| Water Soluble Polymer (3) | 7 |
| Surfactant (2) | 21 |

Support (1) Paper support laminated with polyethylene (thickness 131 μm)

Support (1)

| Layer Name | Composition | Film Thickness (μm) |
|---|---|---|
| Surface Subbing Layer Gelatin | | 0.1 |
| Surface PE Layer (Glossy) | Low density polyethylene (density 0.923) 89.2 parts<br>Surface treated titanium oxide 10.0 parts | 36.0 |
| Pulp Layer | Wood-free paper (LBKP/NBKP = 1/1. density 1.080) | 64.0 |
| Reverse Side PE Layer (Matt) | High density polyethylene (density 0.960) | 31.0 |
| Reverse Side Subbing Layer | Gelatin<br>Colloidal silica | 0.05<br>0.05 |
| TOTAL | | 131.2 |

Surfactant (3)

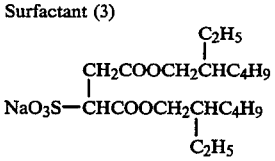

Surfactant (4)

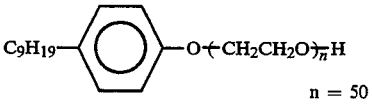

n = 50

Anti-foggant (1)

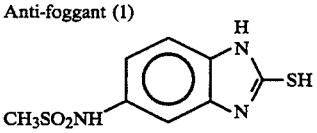

Anti-foggant (2)

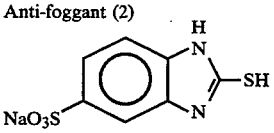

Water Soluble Polymer (3)

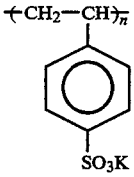

Film Hardening Agent (1)

$CH_2{=}CHSO_2CH_2SO_2CH{=}CH_2$

Surfactant (5)

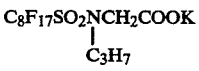

Polymer Latex 1

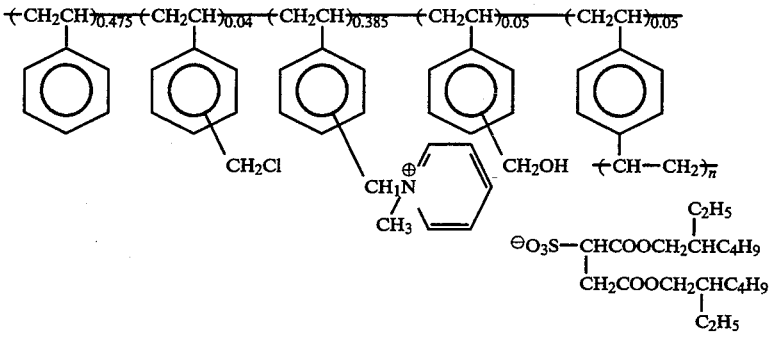

Photosensitive Materials Nos.102–106 of the present invention and Photosensitive Material No. 107 for comparative purposes were prepared in the same way, except that the gelatin dispersions of the respective dye donating compounds Yellow-1, Magenta-1, Cyan-1 whose formulations are shown in Table 1 used in Photosensitive Material No.101 were replaced by those whose the formulations are shown in Tables 9–11. Furthermore, Photosensitive Materials Nos.101–107 were coated using coating liquids immediately after preparation, and they were also coated with the same structure after ageing the coating liquids for 24 hours at 40° C.

Image Receiving Material $R_{101}$ whose the structure is shown in Table 12 was also prepared.

TABLE 9

| | Cyan-2 | Cyan-3 | Cyan-4 | Cyan-5 | Cyan-6 | Cyan-7 |
|---|---|---|---|---|---|---|
| Oil Phase | | | | | | |
| Dye Donating Compound (1) | 9.05 g | 9.05 g | 9.05 g | 9.05 g | 9.05 g | 9.05 g |
| Dye Donating Compound (2) | 6.19 g | 6.19 g | 6.19 g | 6.19 g | 6.19 g | 6.19 g |
| Electron Donor (1) | 4.84 g | 4.84 g | 4.84 g | 4.84 g | 4.84 g | 4.84 g |
| Electron transfer agent precursor | 1.42 g | 1.42 g | 1.42 g | 1.42 g | 1.42 g | 1.42 g |
| Compound of this invention | | | | | | |
| Compound No. | (9) | (1) | (2) | (4) | (29) | — |
| Amount Added | 3.05 g | 1.53 g | 3.05 g | 4.55 g | 3.05 g | — |
| Compound No. | — | (9) | — | — | — | — |
| Amount Added | | 1.52 g | | | | |
| High Boiling Point Solvent (1) | 1.91 g | 1.91 g | 1.91 g | 1.91 g | 1.91 g | 1.91 g |
| High Boiling Point Solvent (3) | 5.72 g | 5.72 g | 5.72 g | 5.72 g | 5.72 g | 5.72 g |
| Surfactant (2) | 1.55 g | 1.55 g | 1.55 g | 1.55 g | 1.55 g | 1.55 g |
| Ethyl acetate | 34.5 ml | 34.5 ml | 34.5 ml | 34.5 ml | 34.5 ml | 34.5 ml |
| Methyl ethyl ketone | 47.5 ml | 47.5 ml | 47.5 ml | 47.5 ml | 47.5 ml | 47.5 ml |
| Aqueous Phase | | | | | | |
| Lime treated gelatin | 10.0 g | 10.0 g | 10.0 g | 10.0 g | 10.0 g | 10.0 g |
| Water Soluble Polymer (1) | 1.50 g | 1.50 g | 1.50 g | 1.50 g | 1.50 g | 1.50 g |
| Water | 150 ml | 150 ml | 150 ml | 150 ml | 150 ml | 150 ml |
| Water | 150 ml | 150 ml | 150 ml | 150 ml | 150 ml | 150 ml |

TABLE 10

| | Magenta-2 | Magenta-3 | Magenta-4 | Magenta-5 | Magenta-6 | Magenta-7 |
|---|---|---|---|---|---|---|
| Oil Phase | | | | | | |
| Dye Donating Compound (3) | 15.5 g | 15.5 g | 15.5 g | 15.5 g | 15.5 g | 15.5 g |
| Electron Donor (1) | 5.61 g | 5.61 g | 5.61 g | 5.61 g | 5.61 g | 5.61 g |
| Electron transfer agent precursor | 1.42 g | 1.42 g | 1.42 g | 1.42 g | 1.42 g | 1.42 g |
| Compound of this invention | | | | | | |
| Compound No. | (9) | (1) | (2) | (8) | (31) | — |
| Amount Added | 3.88 g | 1.94 g | 3.88 g | 3.30 g | 0.2 g | — |
| Compound No. | — | (9) | — | (9) | (1) | — |
| Amount Added | | 1.94 g | | 0.58 g | 1.94 g | |
| High Boiling Point Solvent (1) | 1.94 g | 1.94 g | 1.94 g | 1.94 g | 1.94 g | 1.94 g |
| High Boiling Point Solvent (3) | 5.81 g | 5.81 g | 5.81 g | 5.81 g | 5.81 g | 5.81 g |
| Surfactant (2) | 0.52 g | 0.52 g | 0.52 g | 0.52 g | 0.52 g | 0.52 g |
| Ethyl acetate | 34.5 ml | 34.5 ml | 34.5 ml | 34.5 ml | 34.5 ml | 34.5 ml |
| Methyl ethyl ketone | 47.5 ml | 47.5 ml | 47.5 ml | 47.5 ml | 47.5 ml | 47.5 ml |
| Aqueous Phase | | | | | | |
| Lime treated gelatin | 10.0 g | 10.0 g | 10.0 g | 10.0 g | 10.0 g | 10.0 g |
| Water Soluble Polymer (1) | 1.50 g | 1.50 g | 1.50 g | 1.50 g | 1.50 g | 1.50 g |
| Water Soluble Polymer (2) | 4.5 g | 4.5 g | 4.5 g | 4.5 g | 4.5 g | 4.5 g |
| Water | 150 ml | 150 ml | 150 ml | 150 ml | 150 ml | 150 ml |
| Water | 160 ml | 160 ml | 160 ml | 160 ml | 160 ml | 160 ml |

TABLE 11

| | Yellow-2 | Yellow-3 | Yellow-4 | Yellow-5 | Yellow-6 | Yellow-7 |
|---|---|---|---|---|---|---|
| Oil Phase | | | | | | |
| Dye Donating Compound (4) | 13.0 g | 13.0 g | 13.0 g | 13.0 g | 13.0 g | 13.0 g |
| Electron Donor (1) | 4.53 g | 4.53 g | 4.53 g | 4.53 g | 4.53 g | 4.53 g |
| Electron transfer agent precursor | 0.86 g | 0.86 g | 0.86 g | 0.86 g | 0.86 g | 0.86 g |
| Compound of this invention | | | | | | |
| Compound No. | (9) | (1) | (2) | — | (3) | — |
| Amount Added | 0.65 g | 0.33 g | 0.65 g | | 0.65 g | |
| Compound No. | — | (9) | — | — | — | — |
| Amount Added | | 0.33 g | | | | |
| High Boiling Point Solvent (1) | 5.20 g | 5.20 g | 5.20 g | 5.20 g | 5.20 g | 5.20 g |
| High Boiling Point Solvent (2) | 3.90 ml | 3.90 ml | 3.90 ml | 3.90 ml | 3.90 ml | 3.90 ml |
| Surfactant (2) | 1.50 g | 1.50 g | 1.50 g | 1.50 g | 1.50 g | 1.50 g |
| Ethyl acetate | 25.0 ml | 25.0 ml | 25.0 ml | 25.0 ml | 25.0 ml | 25.0 ml |
| Aqueous Phase | | | | | | |
| Lime treated gelatin | 10.0 g | 10.0 g | 10.0 g | 10.0 g | 10.0 g | 10.0 g |
| Citric acid | 0.14 g | 0.14 g | 0.14 g | 0.14 g | 0.14 g | 0.14 g |
| Water | 120 ml | 120 ml | 120 ml | 120 ml | 120 ml | 120 ml |
| Water | 115 ml | 115 ml | 115 ml | 115 ml | 115 ml | 115 ml |

TABLE 12

The Structure of Image Receiving Material R101

| Layer Number | Material Added | Coated Weight (mg/m$^2$) |
|---|---|---|
| Fourth Layer | Water Soluble Polymer (4) | 240 |
| | Water Soluble Polymer (5) | 60 |
| | Potassium nitrate | 50 |
| | Surfactant (3) | 7 |
| | Surfactant (6) | 5 |
| Third Layer | Gelatin | 250 |
| | Water Soluble Polymer (4) | 10 |
| | Surfactant (7) | 27 |
| | Film hardening agent (2) | 170 |
| Second Layer | Gelatin | 800 |
| | Water Soluble Polymer (4) | 100 |
| | Water Soluble Polymer (5) | 660 |
| | Polymer dispersion | 1190 |
| | High Boiling Point Solvent (5) | 650 |
| | Fluorescent whitener | 22 |
| | Mordant | 2350 |
| | Surfactant (3) | 10 |
| | Guanidine picolinate | 2900 |
| | Mordant | 2350 |
| | Antistaining agent | 32 |
| First Layer | Gelatin | 150 |
| | Water Soluble Polymer (4) | 40 |
| | Surfactant (3) | 6 |
| | Surfactant (7) | 27 |
| | Film Hardening Agent (2) | 170 |
| Support (2) | A paper support laminated with polyethylene (Thickness 206 μm) | |

Support (2)

| Layer Name | Composition | Film Thickness (μm) |
|---|---|---|
| Surface Subbing Layer | Gelatin | 0.1 |
| Surface PE Layer (Glossy) | Low density polyethylene (density 0.923) 89.2 parts<br>Surface treated titanium oxide 10.0 parts<br>Ultramarine 0.8 parts | 35.0 |
| Pulp Layer | Wood-free paper (LBKP/NBKP = 1/1. density 1.080) | 140.8 |
| Reverse Side PE Layer (Matt) | High density polyethylene (density 0.960) | 30.0 |
| Reverse Side Subbing Layer | Gelatin<br>Colloidal silica | 0.05<br>0.05 |
| TOTAL | | 206.0 |

Surfactant (6)

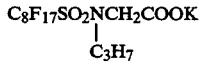

Surfactant (7)

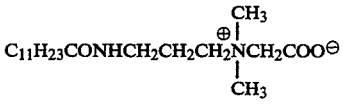

High Boiling Point Solvent (5)

$C_{26}H_{46.9}Cl_{7.1}$

Enpara 40 (Made by Ajinomoto Co., Inc.)

Fluorescent Whitener

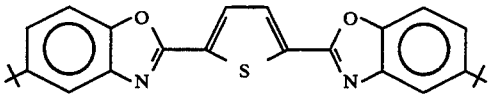

Antistaining Agent

-continued

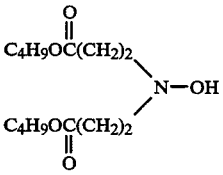

Mordant

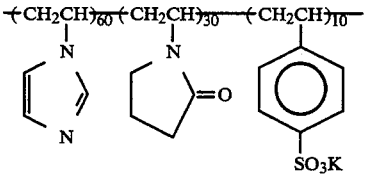

Film Hardening Agent (2)

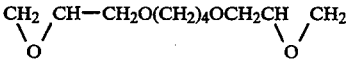

Processing with the image recording apparatus disclosed in Japanese Patent Application No. 63-137104 was carried out using the abovementioned Photosensitive Material Nos. 101–107 and Image Receiving Material R101.

That is to say, an original (a test chart on which Y, M, Cy and grey wedges of continuously varying density had been recorded) was subjected to a scanning exposure through a slit. The exposed photosensitive materials were immersed for 4 seconds in water which was being maintained at 40° C., after which they were laminated immediately using a squeeze roller in such a way that the film surface was in contact with the image receiving material. Next, the combination was heated for 17 seconds using a heated drum whose temperature had been adjusted in such a way that the temperature of the surface which had taken up the water was set to 80° C. On peeling the photosensitive material away from the image receiving material, a sharp color image corresponding to the original was obtained in the image receiving material.

Moreover, uniform grey samples were prepared with adjustment using Fuji Film Co. CC Filters in such a way that a grey density of 0.7 was obtained and the number of spot-like defects per 100 $cm^2$ was evaluated. The results obtained on measuring the minimum and maximum cyan, magenta and yellow densities of the grey part and the numbers of spot-like defects are shown in Table 13.

Furthermore, the abovementioned Photosensitive Material Nos.101–107 were exposed and processed in the same way after being left to stand for 10 days under conditions of 50° C., 50%. The results obtained on measuring the minimum and maximum cyan, magenta and yellow densities of the grey parts are shown in Table 14.

TABLE 13

| Photo-sensitive Material | Coated Immediately After Preparing the Coating Liquids | | | | | | | Coated After Storing the Coating Liquids for 24 Hours at 40° C. After Preparation | | | | | | | |
|---|---|---|---|---|---|---|---|---|---|---|---|---|---|---|---|
| | Dmin | | | Dmax | | | Number of Spot-like defects | Dmin | | | Dmax | | | Number of Spot-like defects | Remarks |
| | Cy | M | Y | Cy | M | Y | | Cy | M | Y | Cy | M | Y | | |
| 101 | 0.08 | 0.12 | 0.09 | 2.45 | 2.50 | 2.40 | 0~1 | 0.09 | 0.13 | 0.10 | 2.40 | 2.45 | 2.30 | 1~3 | This Invention |
| 102 | 0.08 | 0.12 | 0.09 | 2.45 | 2.45 | 2.35 | 0~1 | 0.08 | 0.11 | 0.08 | 2.45 | 2.50 | 2.35 | 1~3 | This Invention |
| 103 | 0.08 | 0.12 | 0.09 | 2.45 | 2.45 | 2.35 | 0~1 | 0.08 | 0.13 | 0.09 | 2.40 | 2.40 | 2.35 | 1~3 | This Invention |
| 104 | 0.09 | 0.13 | 0.10 | 2.45 | 2.50 | 2.40 | 0~1 | 0.09 | 0.12 | 0.09 | 2.45 | 2.50 | 2.35 | 1~3 | This Invention |
| 105 | 0.09 | 0.12 | 0.11 | 2.40 | 2.45 | 2.35 | 0~1 | 0.09 | 0.13 | 0.11 | 2.45 | 2.50 | 2.30 | 1~3 | This Invention |
| 106 | 0.09 | 0.12 | 0.10 | 2.40 | 2.45 | 2.35 | 0~1 | 0.10 | 0.13 | 0.11 | 2.40 | 2.40 | 2.35 | 1~3 | This Invention |
| 107 | 0.09 | 0.13 | 0.10 | 2.45 | 2.50 | 2.40 | 0~1 | 0.18 | 0.19 | 0.15 | 2.35 | 2.40 | 2.30 | 10~50 | Comparative Example |

TABLE 14

| Photosensitive Material | $D_{min}$ After 10 days at 50° C., 50% | | | $D_{max}$ After 10 days at 50° C., 50% | | |
|---|---|---|---|---|---|---|
| | Cy | M | Y | Cy | M | Y |
| 101 | 0.08 | 0.12 | 0.09 | 2.45 | 2.50 | 2.40 |
| 102 | 0.08 | 0.12 | 0.09 | 2.45 | 2.45 | 2.35 |
| 103 | 0.08 | 0.12 | 0.09 | 2.45 | 2.45 | 2.35 |
| 104 | 0.09 | 0.13 | 0.10 | 2.45 | 2.50 | 2.40 |
| 105 | 0.09 | 0.12 | 0.11 | 2.40 | 2.45 | 2.35 |
| 106 | 0.09 | 0.12 | 0.10 | 2.40 | 2.45 | 2.35 |
| 107 | 0.10 | 0.14 | 0.11 | 2.40 | 2.45 | 2.40 |

As is clear from the results presented above, the photosensitive materials of the present invention exhibits no worsening of discrimination or spot-like defects even when the coating liquids were stored for a prolonged period of time after preparation, and they are clearly photosensitive materials which are suitable for mass production. Furthermore, it is clearly possible to obtain images which have excellent discrimination even after prolonged storage.

What is claimed is:

1. A thermally developable color photosensitive material comprising a support, having thereon a photosensitive silver halide, a binder, an electron transfer agent, an electron donor and a reducible dye donating compound which is capable of being reduced and releasing a diffusible dye, wherein the reducible dye donating compound and a compound represented by the following formula(1) are present together in the form of an emulsified dispersion in the binder;

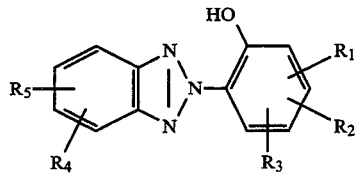

(1)

wherein $R_1$–$R_5$, which which may be the same or different, each represents a hydrogen atom, a halogen atom, or a substituted or unsubstituted aliphatic group, an aromatic group, an alkoxy group, an aryloxy group, an alkylthio group, an arylthio group, an alkylamino group, a nitro group, a carboxamido group, a sulfonamido group, a carbamoyl group, a sulfamoyl group, a sulfonic acid group or ester or salt thereof, a carboxylic acid group or ester or salt thereof, or a heterocyclic group, any of $R_3$–$R_5$ may undergo ring closure with adjoining groups to form five or six membered rings, dimers or larger oligomers may be formed by bonding between any of the substituent groups $R_1$–$R_5$, and polymeric compounds may be formed by bonding into a polymer chain with any of $R_1$–$R_5$.

2. The thermally developable color photosensitive material of claim 1, wherein the amount of the compound represented by formula (1) is 0.1–100 percent by weight with respect to the amount of the dye donating compound.

3. The thermally developable color photosensitive material of claim 1, wherein the amount of the compound of formula (1) is 1–50 percent by weight with respect to the amount of the dye donating compound.

4. The thermally developable color photosensitive material of claim 1, wherein the reducible dye donating compound, the compound of formula (1), the electron transfer agent and the electron donor are contained in the form of an emulsified dispersion.

5. The thermally developable color photosensitive material of claim 1, wherein the compound of formula (1) is in the form of a dimer.

6. The thermally developable color photosensitive material of claim 1, wherein the compound of formula (1) is in the form of a larger oligomer.

7. The thermally developable color photosensitive material of claim 1, wherein the compound of formula (1) is part of a polymer.

* * * * *